US005174268A

United States Patent [19]

Martin et al.

[11] Patent Number: 5,174,268

[45] Date of Patent: Dec. 29, 1992

[54] COMPOUND ARCHERY BOW

[75] Inventors: Terry G. Martin; George T. Newbold, both of Walla Walla, Wash.

[73] Assignee: Martin Archery, Inc., Walla Walla, Wash.

[21] Appl. No.: 718,207

[22] Filed: Jun. 20, 1991

[51] Int. Cl.[5] ..... F41B 5/00

[52] U.S. Cl. ..... 124/25.6; 124/900

[58] Field of Search ..... 124/23.1, 25.6, 900

[56] References Cited

U.S. PATENT DOCUMENTS

| | | | |
|---|---|---|---|
| 3,486,495 | 12/1969 | Allen | 124/25.6 |
| 3,851,638 | 12/1974 | Alexander | 124/25.6 |
| 3,993,039 | 11/1976 | Groves et al. | 124/25.6 |
| 4,060,066 | 11/1977 | Kudlacek | 124/900 X |
| 4,368,718 | 1/1983 | Simonds et al. | 124/25.6 |
| 4,401,097 | 8/1983 | Simonds et al. | 124/900 X |
| 4,438,753 | 3/1984 | Simonds | 124/900 X |
| 4,478,203 | 10/1984 | Hayes | 124/25.6 |
| 4,512,326 | 4/1985 | Jarrett | 124/900 X |
| 4,515,142 | 5/1985 | Nurney | 124/25.6 |
| 4,519,374 | 5/1985 | Miller | 124/900 X |
| 4,561,413 | 12/1985 | Jennings | 124/25.6 |
| 4,649,890 | 3/1987 | Powers | 124/25.6 |
| 4,739,744 | 4/1988 | Nurney | 124/25.6 |
| 4,770,154 | 9/1988 | Cook et al. | 124/25.6 |
| 4,774,927 | 10/1988 | Larson | 124/25.6 |
| 5,031,599 | 7/1991 | Cruise | 124/900 X |
| 5,040,520 | 8/1991 | Nurney | 124/900 X |

OTHER PUBLICATIONS

Instruction Manual, "Martin Cheetah DynaBo", Martin Archery, Inc., prior to 1980, Color Press, College Place, Wash.

*Primary Examiner*—Randolph A. Reese
*Assistant Examiner*—Jeffrey L. Thompson
*Attorney, Agent, or Firm*—Wells, St. John, Roberts, Gregory & Matkin

[57] ABSTRACT

Eccentric wheels of a compound archery bow are mounted in respective bow limb receiving slots for pivotal movement between a rest draw angular position and a full draw angular position. Each wheel pivot axis extends transversely across the respective wheel receiving slot and is spaced an effective preset slot depth distance A from the respective slot root. Each wheel has a bowstring portion with a peripheral bowstring track formed therein for receiving a section of a bowstring. The peripheral bowstring track has a progressively increasing moment arm radius relative to the respective pivot axis from a rest draw segment to a full draw segment. The moment arm radius from the pivot axis to the full draw segment of the bowstring portion is greater than the effective slot depth distance A to extend the effective length of the respective flexible power limb at the full draw angular position by a distance greater than the slot depth. The wheel full draw segments of the bowstring portion in the rest draw angular position are positioned forwardly over the respective bow limbs and are separated from one another by a distance B which is less than a distance C separating the respective wheel axles. The wheel full draw segments of the bowstring portions in the full draw angular position are positioned rearwardly of the respective bow limbs and are separated from one another by a distance D which is greater than a distance C' separating the wheel axles at full draw.

15 Claims, 10 Drawing Sheets

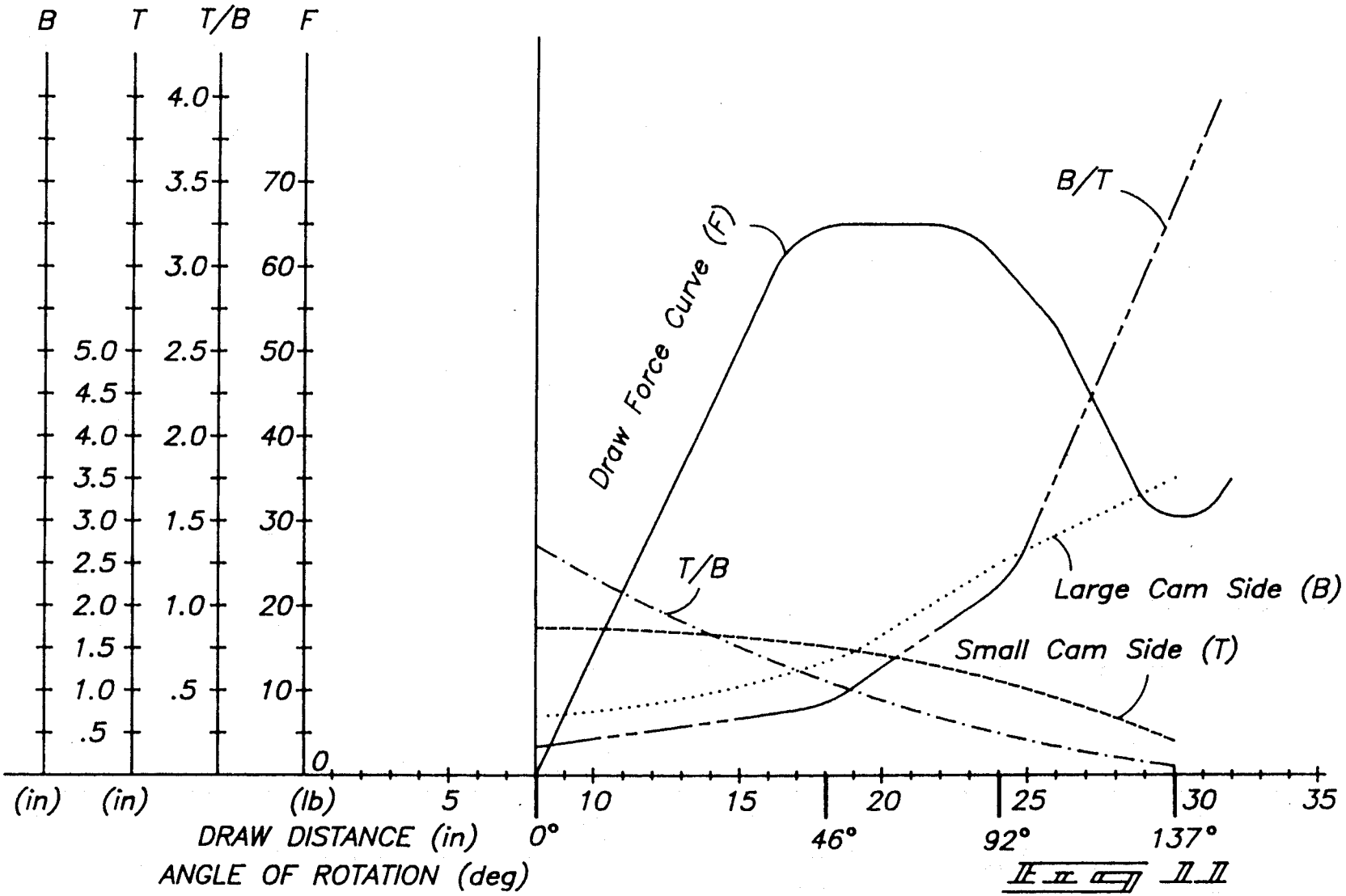
B/T
Large Cam Side (B)
Small Cam Side (T)
T/B
Draw Force Curve (F)
B (in)
T (in)
T/B
F (lb)
4.0
3.5
3.0
2.5
2.0
1.5
1.0
.5
5.0
4.5
4.0
3.5
3.0
2.5
2.0
1.5
1.0
.5
70
60
50
40
30
20
10
0
0
5
10
15
20
25
30
35
DRAW DISTANCE (in)
0°
46°
92°
137°
ANGLE OF ROTATION (deg)

COMPOUND ARCHERY BOW

TECHNICAL FIELD

This invention relates generally to improvements in compound archery bows.

BACKGROUND OF THE INVENTION

Numerous attempts have been made to develop short, stiff-limbed archery bows with low-rotation eccentrics that provide smooth retracting of the bowstring to the full-draw position while at the same time storing substantial energy and minimizing nock-angle pinch. This invention includes, in part, a construction which overcomes many of the disadvantages previously inherent in stiff-limb short bows that have low-rotation eccentrics. Further, this invention in part includes or enables a stiff-limb short compound bow construction that has many of the attributes of much longer bows without compromising the favorable attributes of a shorter bow.

These and other objects and advantages of the invention will become apparent from the following discussion.

BRIEF DESCRIPTION OF THE DRAWINGS

Preferred embodiments of the invention are described below with reference to the accompanying drawings.

FIG. 7 is a set of superimposed graphs illustrating characteristics of the bow of FIGS. 1-6.

DETAILED DESCRIPTION OF PREFERRED EMBODIMENTS

The following disclosure of the invention is submitted in furtherance with the constitutional purpose of the U.S. Patent Laws "to promote the progress of science and useful arts" (Article 1, Section 8).

Figure 1:
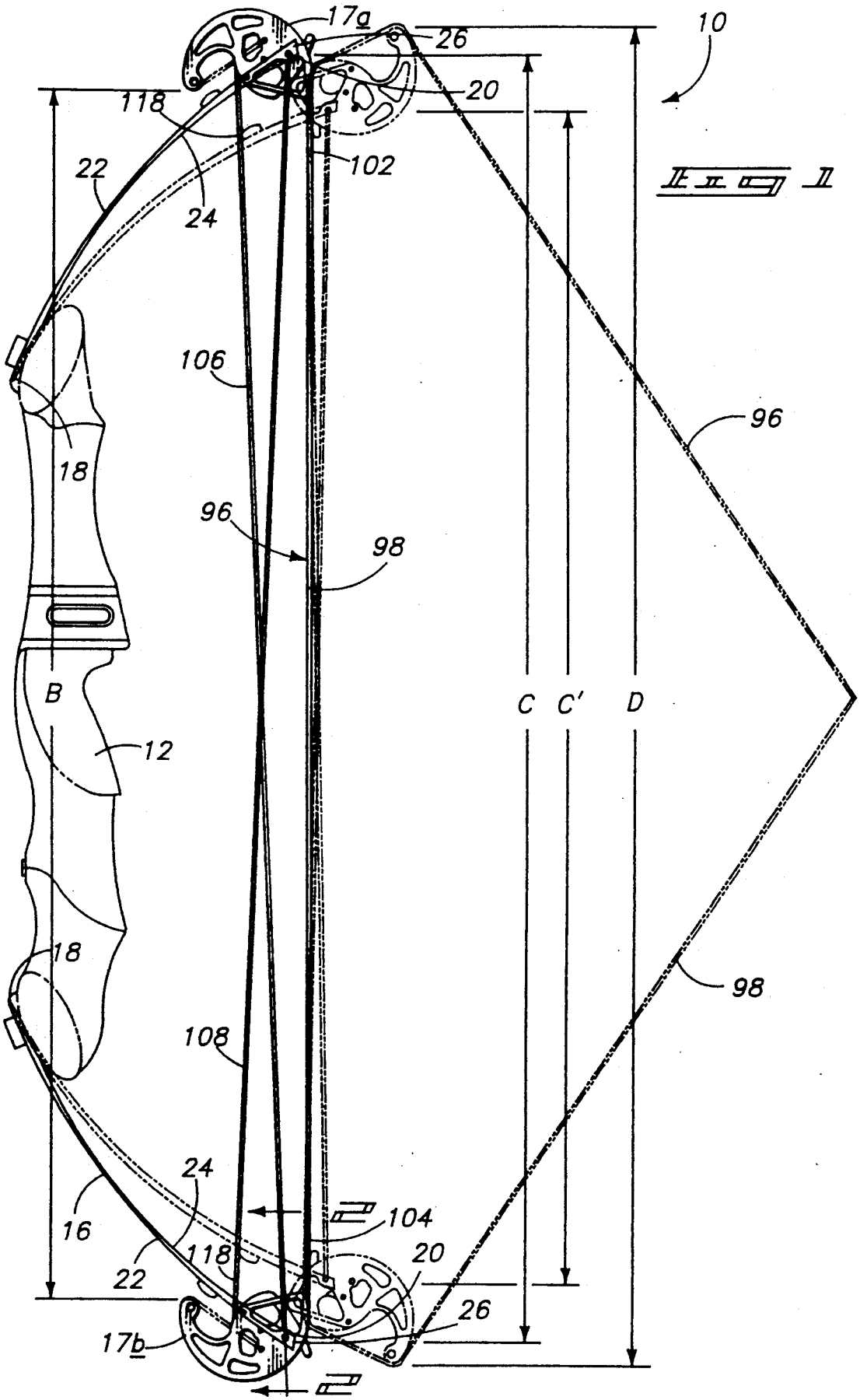
FIG. 1 is a side elevational view of a compound archery bow showing eccentric wheels mounted at the ends of flexible bow limbs in which the bow at rest draw position is shown in solid line and the bow at full draw position is shown in dotted line.

Referring now to the drawings, there is illustrated in FIG. 1 a compound archery bow generally designated with the numeral 10. Compound archery bow 10 includes a central handle section 12, an upper flexible limb 14 and a lower flexible limb 16. Limbs 14 and 16 extend outwardly in opposite directions from opposing ends of the handle for receiving mirror-image eccentric wheels 17*a* and 17*b*, respectively. Each limb 14, 16 has an inner end 18 mounted to central handle 12 and an outer free end 20 for receiving one of wheels 17*a* or 17*b*. Each limb 14, 16 has an outer concave surface 22 and an inner convex surface 24. Limbs 14, 16 extend outward to the outer free ends 20 terminating in distal tips 26.

Figure 2:
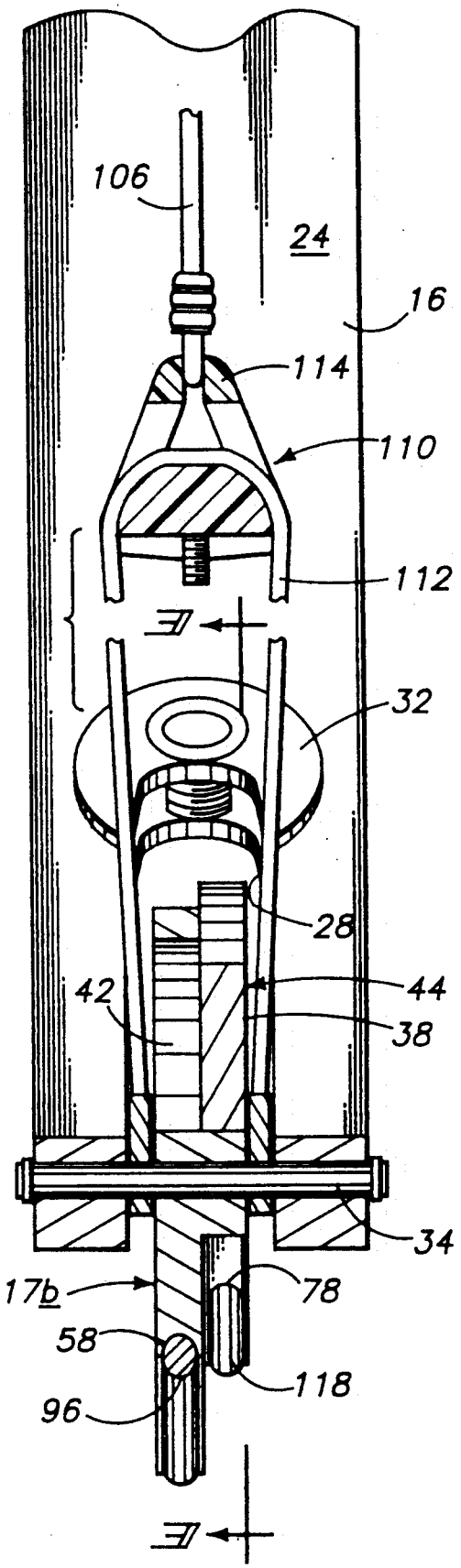
FIG. 2 is an enlarged vertical cross-sectional view taken along line 2—2 in FIG. 1 at the rest draw position, illustrating a transverse cross-section of one of the eccentric wheels with adjacent bowstring and power cable tracks.
Figure 6:
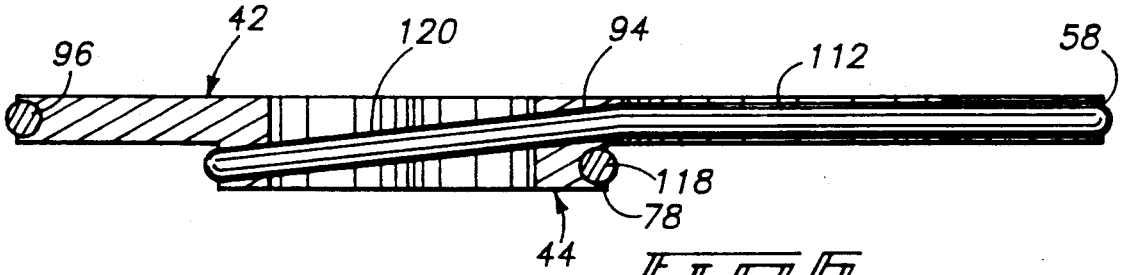
FIG. 6 is a vertical cross-sectional view taken along line 6—6 in FIG. 3 illustrating a track interconnecting passageway receiving a transition cable section.
Figure 3:
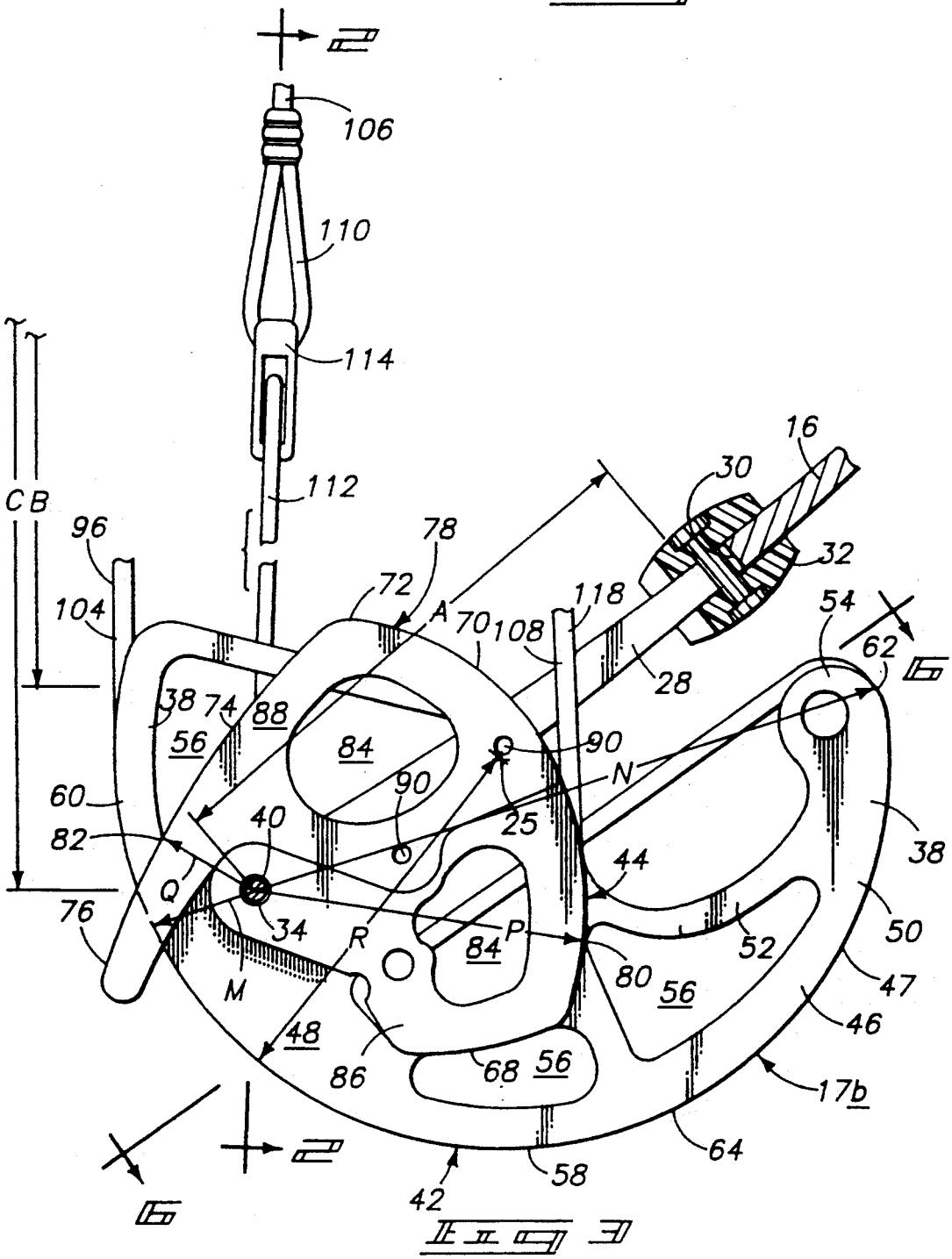
FIG. 3 is a vertical, partial cross-sectional view taken along line 3—3 in FIG. 2 illustrating a side view of one of the eccentric wheels in a rest draw position. The view is from the opposite side of the bow from that illustrated in FIG. 1.
Figure 4:
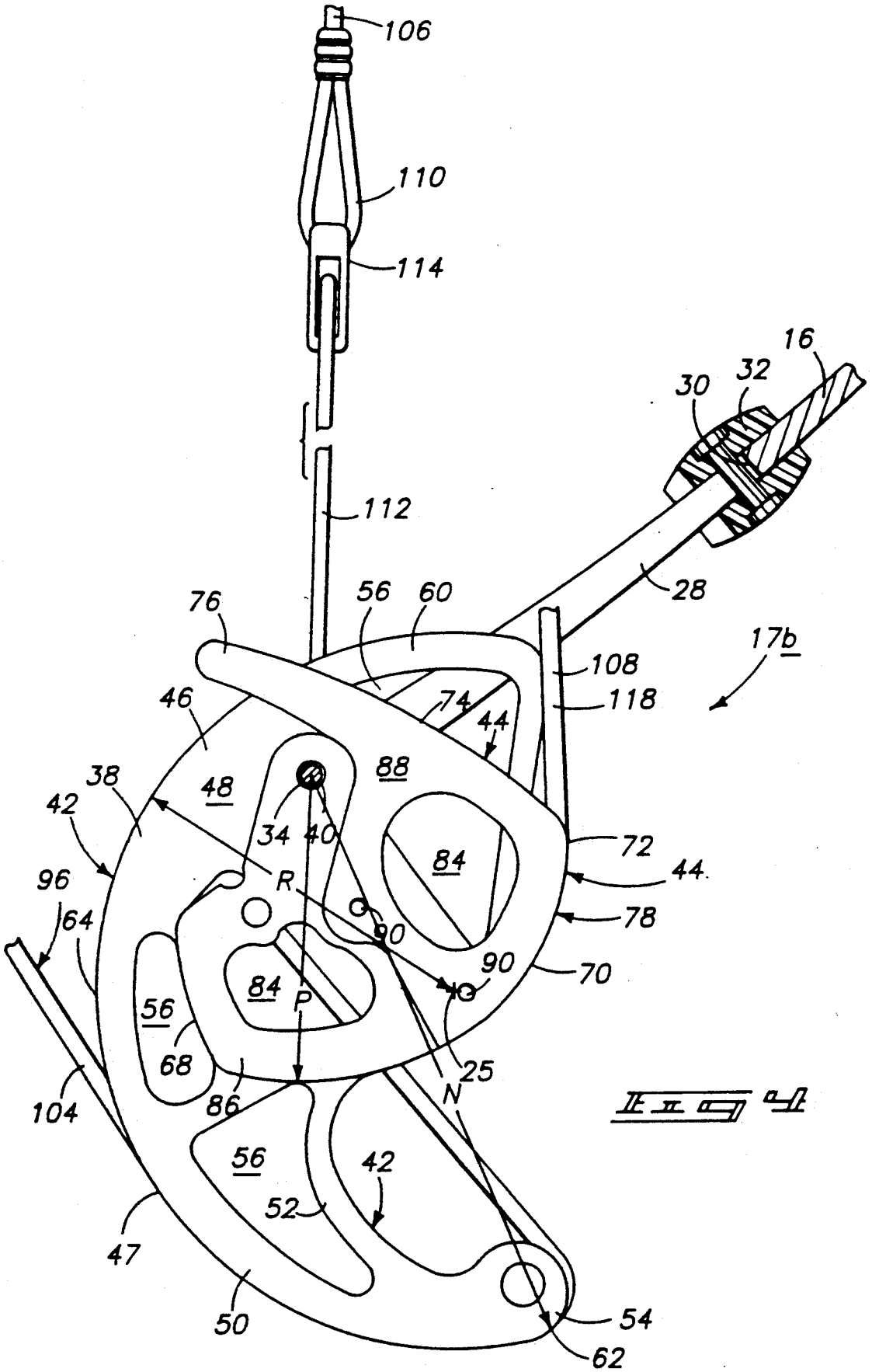
FIG. 4 is a vertical, partial cross-sectional view similar to FIG. 3 except illustrating the eccentric wheel at an intermediate draw condition at the beginning of a significant let-off in required draw force.
Figure 5:
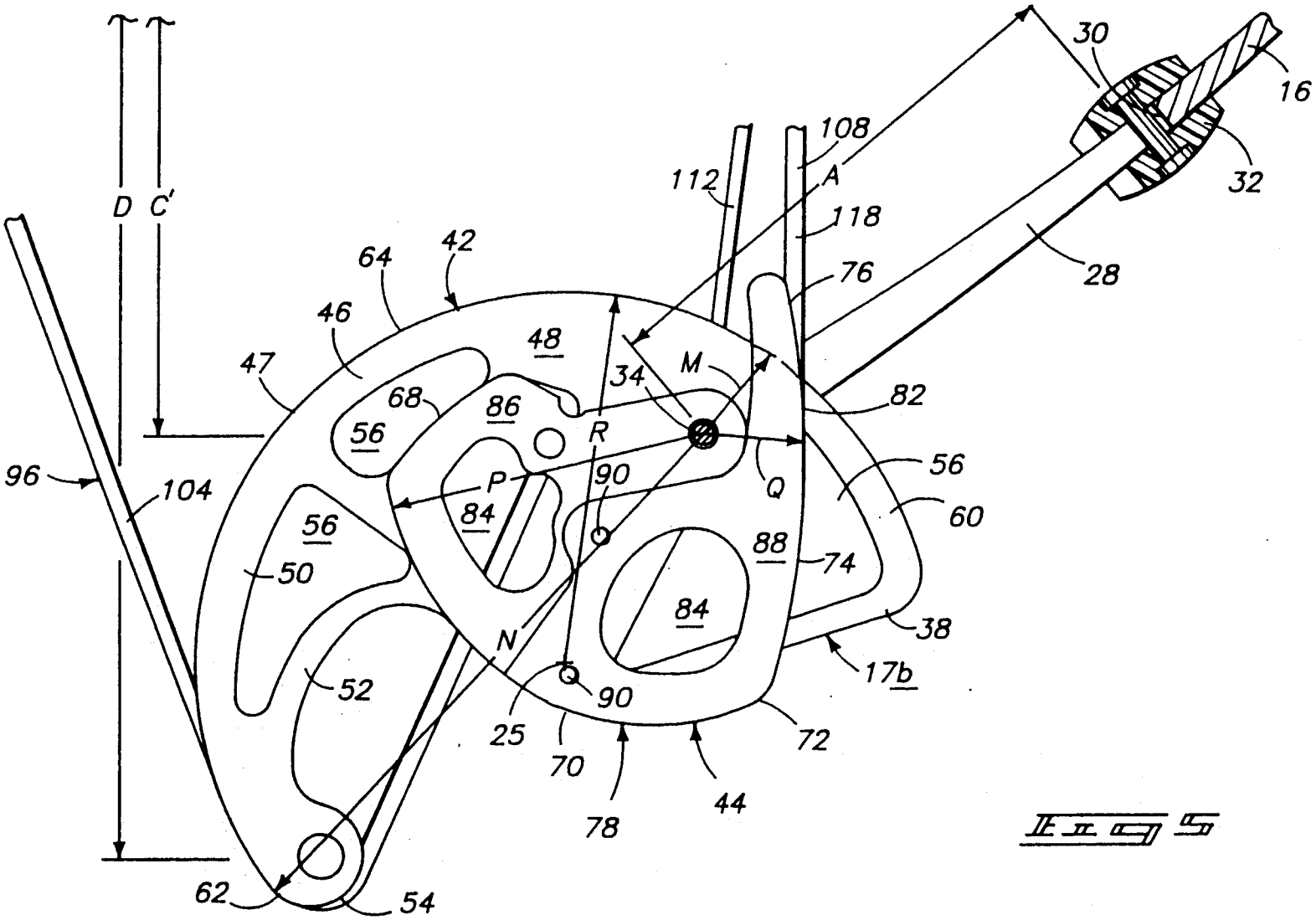
FIG. 5 is a vertical, partial cross-sectional view similar to FIGS. 3 and 4 except illustrating the eccentric wheel in a full draw position.

Each limb 14, 16 has a longitudinal wheel receiving slot 28 (FIG. 2) formed in outer end 20 thereof and extending inward toward the inner end 18 terminating in a slot root 30 (FIGS. 3-5). Bow 10 includes a stress relieving device 32 mounted to limbs 14 and 16 adjacent the roots 30 for reliving stress concentration, as is well known in the art.

Bow 10 includes axles 34 mounted at outer ends 20 of the limbs 14, 16 for pivotally supporting wheels 17*a*, 17*b*. Each axle 34 is preferably mounted adjacent the distal tip 26 defining an eccentric wheel pivot axis 34. Wheels 17*a* and 17*b* are thereby supported for pivotal movement about an eccentric wheel pivot axis between a rest draw angular position and a full draw angular position. The pivot axes 34 are spaced a preset distance A from the effective length of wheel slot 28. (FIG. 3). Device 32 by its presence shortens the effective slot length as indicated. Distance A in the depicted embodiment is preferably 8.6 cm.

The discussion proceeds in more detail with reference to FIGS. 3-6 which illustrate lower wheel 17*b* under different draw conditions. Wheel 17*a* is identically constructed in mirror image to wheel 17*b*. Each wheel 17*a*, 17*b* includes a wheel body 38 having an eccentric bearing 40 for rotatably mounting the respective wheel on axle 34 for rotation. Each wheel body 38 includes a bowstring portion or section 42 and an adjacent power cable portion or section 44.

Bowstring portion 42 comprises a circular segment 46 having a periphery 47 that extends in a substantially constant circular radius R from a center point 25 and beyond 180°. In the illustrated embodiment, radius R equals approximately 6.4 centimeters. Circular segment 46 includes a central portion 48 and an arched cantilever portion 50 that extends radially outward in an arched cantilever orientation from central portion 48. Arched cantilever portion 50 has a neck section 52 that extends outward to a distal tip or nose portion 54 that is rounded. Neck portion 52 is undercut. Bowstring portion 42 includes a number of cut out portions 56 that reduce the weight and mass of portion 42 to reduce forces transferred from wheels 17*a* and 17*b* to limbs 14, 16 by the mass of wheels 17*a* and 17*b* themselves.

Bowstring portion 42 has a bowstring groove or track 58 formed in periphery 47 for receiving a section of a bowstring 96. Track 58 extends in a substantial longitudinal plane that is normal to pivot axis 34. Bowstring track 58 includes a rest draw arcuate segment or location 60 that defines a minimum moment arm radius M with pivot axis 34. In the depicted embodiment, minimum moment arm radius M is approximately 1.7 cm. Bowstring track 58 extends progressively outward from pivot axis 34 to a full draw track segment or location 62 that defines a maximum moment arm radius N. In the depicted embodiment, moment arm N equals approximately 10.3 cm. An intermediate segment or location 64 extends from rest draw segment/location 60 to full draw segment/location 62 and has a progressively increasing radius from pivot axis 34. Moment arm radius N of full draw segment 62 is greater than the effective slot depth distance A to extend the effective length of the respective flexible power limb at the full draw angular position by a distance greater than the slot depth. (See FIG. 5). This provides an advantage of increasing overall limb length and decreasing the amount of movement on bow portion of the wheel. Additionally, less limb travel results.

Power cable section 44 includes an initial wrap portion 68, an arcuate power portion 70, a transition portion 72, a let-off portion 74 and a brake or overdraw portion 76. Power cable section 44 has a peripheral power cable track 78 extending about the periphery of the initial wrap portion 68, the power portion 70, the transition portion 72, the let-off portion 74 and the brake portion 76. Power cable track 78 has a rest draw track segment or location 80 that is a part of power portion 70 and defines a maximum moment arm "P" with respect to pivot axis 34. In the depicted embodiment, power portion 70 has an arcuate distance of approximately 60° or more and a constant radius with respect to pivot axis 34. Maximum moment arm radius "P" equals 4.4 cm. Full draw moment arm radius N of bowstring portion 42 is greater than twice maximum moment arm radius P of power cable portion 44. Maximizing moment arm N relative to P in this manner provides an advantage of creating a larger more gradual curve for the cables which increases their life. Further, P is less than R. This provides an advantage of maintaining a smooth consistent draw force, and also displaces the draw weight in the direction of the early part of the draw to add more leverage to the archer during the act of pulling the bowstring.

Power cable track 78 has a full draw segment or location 82 formed in let-off portion 74. The full draw segment/location 82 represents a minimum moment arm radius Q with respect to pivot axis 34. In the depicted embodiment, the minimum moment arm radius Q equals approximately 1.9 cm. Like the bowstring portion 42, power cable portion 44 has cut out portions 84 to minimize the mass and momentum of the wheels 17*a*, 17*b* to minimize the forces exerted on limbs 14 and 16.

Power cable portion 44 is shown as being formed in two parts: one being a permanent segment 86 that is formed integrally with bowstring section 42 and the other being an attachable segment 88. Segment 88 can be removed, with other segments being inserted to change the draw length and peak force of the bow as desired. Segment 88 extends from power portion 70 and includes transition portion/peak 72, let-off portion 74 and brake section 76. Segment 88 is removably secured to the side of bowstring portion 42 by threaded bolts 90. Each wheel body 38 includes an intertrack transition passageway 94 (FIG. 6) that extends between bowstring track 58 and the power cable track 78.

Bowstring 96 includes a central stretch 98 (FIG. 1) having a nock midway between pivot axes 34 of eccentric wheels 17*a* and 17*b*. Bowstring 96 has upper and lower end sections 102 and 104 respectively, that extend to and are disposed in bowstring track 58 of wheels 17*a* and 17*b*. Bow 10 further includes power cables 106 and 108 that extend between the limb ends. Each power cable 106 and 108 includes an anchor end 110 connected to a yoke assembly 112. Yoke assembly 112 connects to an axle 34. Anchor ends 110 connect to yoke assembly 112 through an adjustable tension device 114 such as is shown in our U.S. Pat. No. 4,781,167. From anchor ends 110, each power cable 106 and 108 extends in a power cable span segment from one limb to the other limb to take up segment 118 that is disposed in the power cable track 78 of the opposite wheel assembly 17*a* or 17*b*. The bowstring 96 and power cables 106 and 108 are interconnected by track transition segments 120 within passageway 94. In the illustrated embodiment, power cable end 110, the power cable span segment, take up segment 118, track transition segment 120 and bowstring end sections 102, 104 are formed of one length of an integral cable with the cable being wound around the wheels and through intertrack transition passageway 94.

During operation of the bow, the bowstring and cabling are rigged as illustrated in FIGS. 1 and 3 in the rest draw position. The respective axles/axes are separated from one another by a distance C. Bowstring portion rest draw segment 60 joins and is substantially tangent with bowstring 96. Bowstring portion full draw segments 62 extend forwardly and downward in an arched orientation over the respective bow limbs and extend beyond wheel slot distance A. Full draw segments 62 are separated from one another by a distance B which is less than the distance C. Segments/locations 62 are therefor both forward over the bow limbs and overcenter with respect to axes 34.

FIG. 4 illustrates eccentric wheel 17*b* at a transition position after peak forces have been obtained and as let-off is begun. Up to this point, the moment arm radius between the power cable and the pivot axis has remained rather constant (substantially equal to P) while the moment arm of the intermediate bowstring segment 64 has progressively increased to compensate for the increased resistance of the limbs. This assists the archer in withdrawing the bowstring from the rest position as increased resistance is encountered. This enables the archer to increase the energy loading of the bow while at the same time enabling the archer to conveniently counter the increased resistance of the bow limbs. Consequently, the archer feels a much more gradual and even pull required on the bowstring to retract the bow towards the full draw position.

At the transition point, portion 72 of the power cable wheel section curves rather dramatically into the let-off portion 74, where the moment arm will thereafter decrease rather rapidly from the maximum moment arm radium P to the minimum moment arm radius Q. Consequently, there is a substantial let-off in required draw force within a relatively few degrees of rotation of wheel 17*a* and 17*b* with respect to pivot axes 34. However, such relatively small angular degree movement of the wheel generates a rather large movement of the nock position of the bow because of the large arc (moment arm N) of the full draw segments 62 about pivot axes 34.

The full draw position is illustrated in FIGS. 1 and 5. Here, limbs 14 and 16 are flexed toward one another such that axes 34 are separated from one another by a distance C', which is less than the at-rest distance C. Bowstring portion full draw segments 62 extend rearwardly of the respective bow limbs and are separated from one another by a distance D. Distance D is greater than the distance C' thereby extending the effective lengths of the limbs at the full draw angular position and reducing bowstring pinch angle.

Further, the arcuate movement of the wheels 17*a* and 17*b* from the rest draw angular position to the full draw angular position rotate a distance less than 200°, and preferably less than 180°. Even more preferably, eccentric wheel rotation is less than 150°. Minimizing degree of rotation in this manner provides an advantage of less limb deflection, which increases limb life. It also provides for a faster recovery of the limb and wheel during shooting for a faster arrow speed and less shock to the archer. In the depicted FIGS. 1–6 embodiment, rotation is 149°.

Further, bowstring portion full draw segments 62 in the full draw position are in an undercenter orientation with additional rotation and overdraw being retarded by brake sections 76 of power cable portion 44. Brake sections 76 causes a dramatic increase in the force required for further draw of the bowstring, thereby preventing or minimizing the possibility of overloading the limbs or causing the full draw segment 62 to rotating to an overdraw orientation.

Characteristics of the FIGS. 1–6 bow are shown graphically in FIG. 7. Curve F is the force curve for the bow as a function of draw length and degree of rotation of wheels 17*a* and 17*b*. Curve B is a function of the moment arm of the large wheel 42 throughout draw. Curve T is a function of the moment arm of the small wheel 44 throughout draw. The respective ratios of T and B are illustrated by curves T/B and B/T.

The discussion proceeds with reference to an alternate embodiment wheel of a compound bow in accordance with the invention of FIGS. 8–11. Components of the FIGS. 8–11 embodiment which correspond to those of the first described embodiment are similarly numbered with the suffix "a". Where the components are identical in construction, the same numbers without any suffix are used. The same limb 14 is illustrated as having a longitudinal wheel receiving slot 28 (FIG. 8) which terminates in a slot root 30. Stress relieving device 32 is mounted to limb 14 adjacent root 30 for relieving stress concentration, as is well known in the art. An axle/pivot axis 34 pivotally or rotationally supports an alternate embodiment wheel 17*c*. Pivot axis 34 is spaced a present distance A from the effective length of wheel slot 28. The discussion proceeds with reference to wheel 17*c*. An opposing wheel on the lower limb would be identically constructed in mirror image to wheel 17*c*.

Wheel 17*c* includes a wheel body 38*a* having an eccentric bearing 40 for rotatably mounting the wheel on axle 34 for rotation. Wheel body 38*a* includes a bowstring portion or section 42*a* and an adjacent power cable portion or section 44*a*. Bowstring portion 42*a* in this embodiment is comprised of a non-circular segment 46*a* having a non-circular periphery 47*a*. Providing segment 46*a* in the depicted non-circular manner results in an increase in the length of drawing at peak force and produces peak draw force earlier in the draw as compared to the circular profile of segment 46 of the FIGS. 1–7 embodiment. Segment 46*a* includes a central portion 48*a* and an arched cantilever portion 50*a* that extends radially outward in an arched cantilever orientation from central portion 48*a*. Arched cantilever portion 50 has a neck section 52*a* that extends outward to a distal tip or nose portion 54*a* that is rounded. Neck portion 52*a* is undercut. Bowstring portion 42*a* includes a number of cutout portions 56*a* that reduce the weight and mass of portion 42*a* to reduce forces transferred from wheel 17*c* to limb 14 by the inherent mass of wheel 17*c*.

Bowstring portion 42*a* is provided with a peripheral bowstring groove or track 58*a* which receives a section of a bowstring 96*a*. Bowstring track 58*a* extends in a substantial longitudinal plane that is normal to pivot axis 34. Bowstring track 58*a* includes a rest draw arcuate segment or location 60*a* that defines a minimum moment arm radius G with pivot axis 34. In the depicted embodiment, minimum moment arm radius G is approximately 1.7 cm. Bowstring track 58*a* extends progressively outward from pivot axis 34 to a full draw track segment or location 62*a* that defines a maximum moment arm radius H. In the depicted embodiment, moment arm H equals approximately 8.7 cm. An intermediate segment 64*a* extends from rest draw segment/location 60*a* to full draw segment/location 62*a* and has a progressively increasing radius from pivot axis 34. Moment arm radius H of full draw segment 62*a* is greater than the effective slot depth distance A to extend the effective length of the respective flexible power limb at the full draw angular position by a distance greater than the slot depth.

Power cable section 44*a* includes an initial wrap portion 68*a*, an arcuate power portion 70*a*, a transition portion 72*a*, a let-off portion 74*a* and a break or overdraw portion 76*a*. Power cable section 44*a* has a peripheral power cable track 78*a* extending about the periphery of the initial wrap portion 68*a*, the power portion 70*a*, the transition 72*a*, the let-off portion 74*a* and the brake portion 76*a*. Power cable track 78*a* has a rest draw track segment or location 80*a* that is part of power portion 70*a* and defines a maximum moment arm "S" with respect to pivot axis 34. In the depicted embodiment, power portion 70*a* is of a changing radius with respect to pivot axis 34. Such enables use of heavier, stiffer limbs, and to allow for different replaceable draw length elements yet with consistent weight reduction at full draw with each different element. Maximum moment arm radius "S" equals 4.4 cm.

Power cable track 78*a* has a full draw segment or location 82*a* formed in let-off portion 74*a*. The full draw segment/location 82*a* represents a minimum moment arm radius "V" with respect to pivot axis 34. In the depicted embodiment, minimum moment arm radius "V" is equally to approximately 1.1 cm.

Power cable portion 44*a* is shown as being formed in two parts: one being a permanent segment 86*a* that is formed integrally with bowstring section 42*a* and the other being an attachable segment 88*a*. Segment 88*a* can be removed, with other segments being inserted to change the draw length and peak force of the bow as desired. Segment 88*a* extends from power portion 70*a* and includes transition portion/peak 72*a*, let-off portion 74*a* and brake section 76*a*. Segment 88 is removably secured to the side of bowstring portion 42*a* by threaded bolts 90*a*.

A power cable 108*a* is received with respect to power cable portion 44*a*. In this embodiment, bowstring 96*a* and power cable 108*a* are not formed as an integral cable. Bowstring 96*a* curves around bowstring portion tip 54*a* and is secured to the side of bowstring portion 42*a* by means of a threaded anchor 5. Power cable 108*a* wraps around power cable track 78*a* as indicated and is received through a hole 6 within section 86*a*. Power cable 108*a* is provided with an enlarged bead 7 which holds power cable 108*a* fast relative to portion 86*a*. The opposing power cable 106*a* secures relative to limb 14 by a yoke system described with respect to the above-described embodiment. Such is not illustrated in the FIGS. 8–10.

Figure 8:
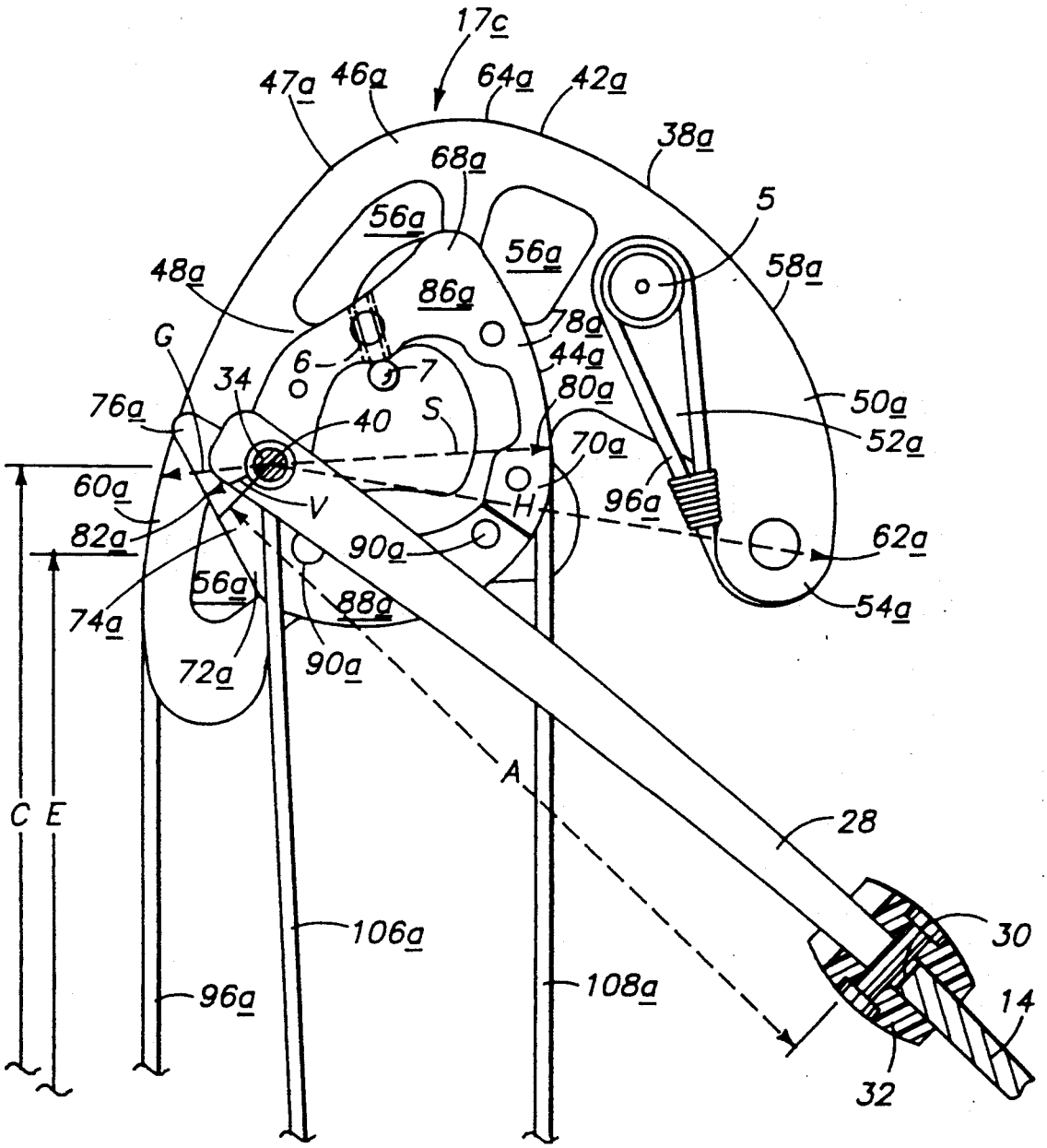
FIG. 8 illustrates an alternate embodiment cam wheel assembly of a compound bow in accordance with the invention shown in the rest draw condition and thereby corresponds to the FIG. 3 position of the FIGS. 1-6 bow.

During operation of the bow, the bowstring and cabling are rigged as illustrated in FIG. 8 in the rest draw position. The respective axles and axes are separated from one another by a distance C. Bowstring rest draw segment 60*a* joins it in substantially tangent with bowstring 96*a*. Bowstring portion full draw segments 62*a* extend forwardly and downward in an arched orientation over the respective bow limbs and extend beyond wheel slot distances A. Full draw segments 62*a* are separated from one another by a distance E which is less than distance C. Segments/locations 62*a* are therefore both forward over the bow limbs and over center with respect to axes 34.

Figure 9:
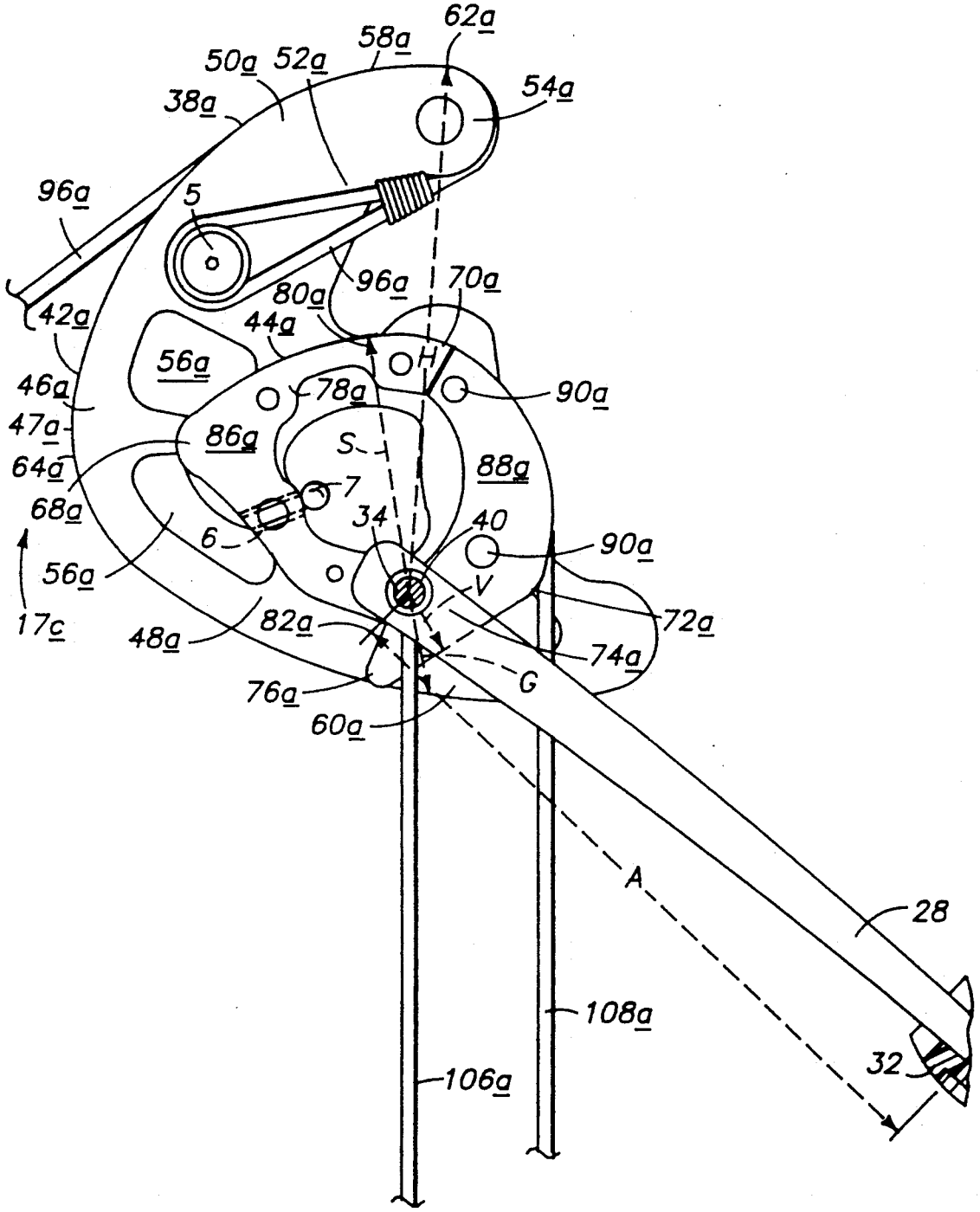
FIG. 9 illustrates the FIG. 8 cam wheel at an intermediate draw condition at the beginning of a significant let-off in required draw force, and thereby corresponds to the FIG. 4 position of the FIGS. 1-6 bow.

FIG. 9 illustrates eccentric wheel 17*c* at a transition position after peak forces have been obtained and as let-off is begun. Up to this point, the moment arm radius between the power cable and pivot axis 34 has progressively been decreasing while the moment arm of the intermediate bowstring segment 64*a* has progressively increased to compensate for the increased resistance of the limbs. At the transition point, portion 72*a* of the power cable wheel section curves into the let-off portion 74*a*, where the moment arm will thereafter decrease rapidly to the minimum moment arm radius V. Consequently, there is a substantial let-off within a relatively few degrees of rotation of wheel 17*c* with respect to pivot axis 34. However, such relatively small angular degree of movement of the wheel generates a rather large movement of the nock position of the bow because of the large arc (moment arm H) of the full draw segments 62*a* about the pivot axes 34.

Figure 10:
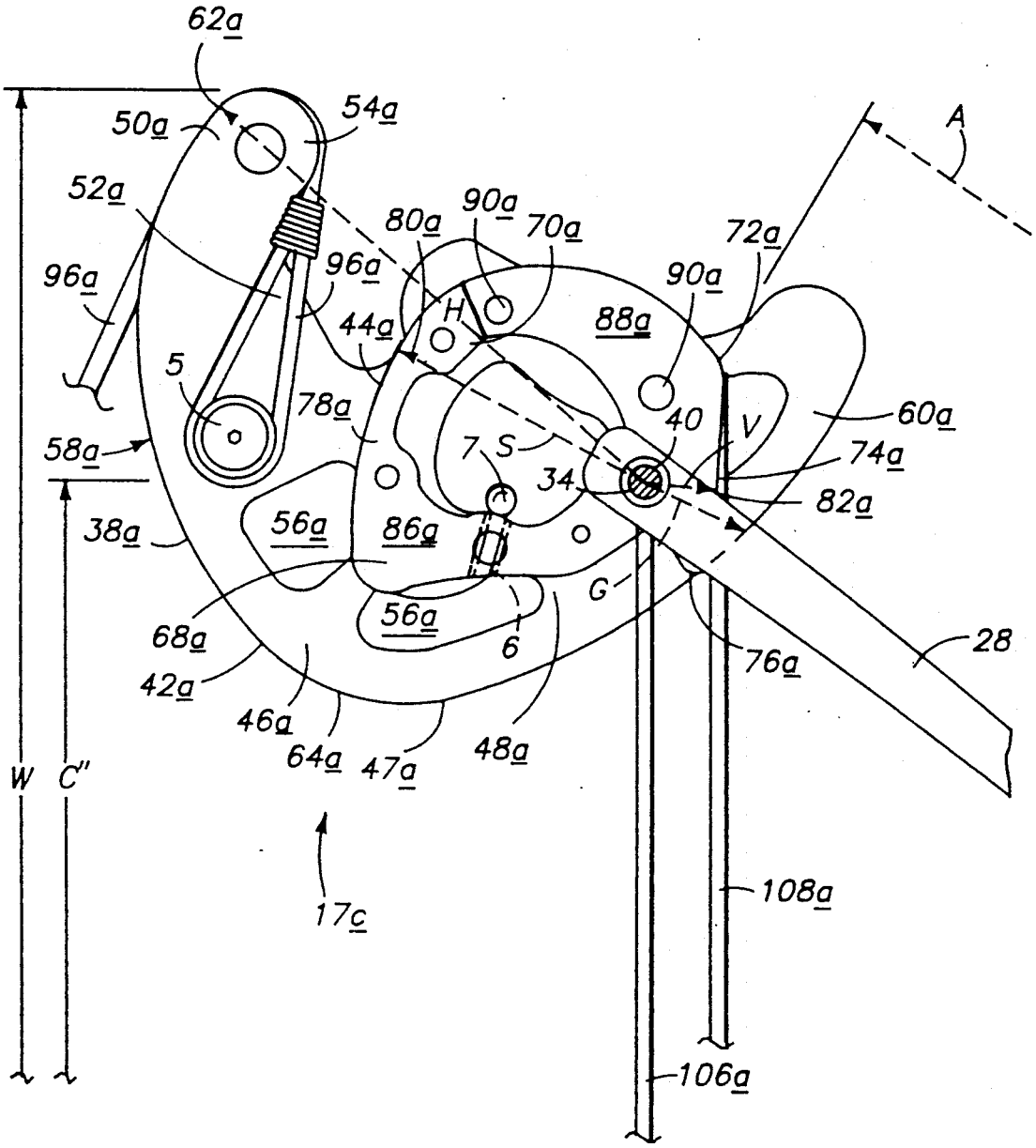
FIG. 10 illustrates the FIGS. 8 and 9 cam wheel at a full draw condition and thereby corresponds to the FIG. 5 position of the FIGS. 1-6 bow.

The full draw position is illustrated in FIG. 10. Here, limbs 14 and 16 are flexed toward one another such that axes 34 are separated from one another by some distace C", which is less than the at-rest distance C. Bowstring portion full segments 62*a* extend rearwardly of the respective bow limbs and are separated from one another by a distance W. Distance W is greater than distance C" thereby extending the effective lengths of the limbs at the full draw angular position and reducing bowstring pinch angle. Rotation of wheel 17*c* from the rest draw position to full draw position in the depicted embodiment is 137°. Brake section 76*a* causes a dramatic increase in the force required for further draw of the bowstring, thereby preventing or minimizing an over draw condition.

Figure 11:
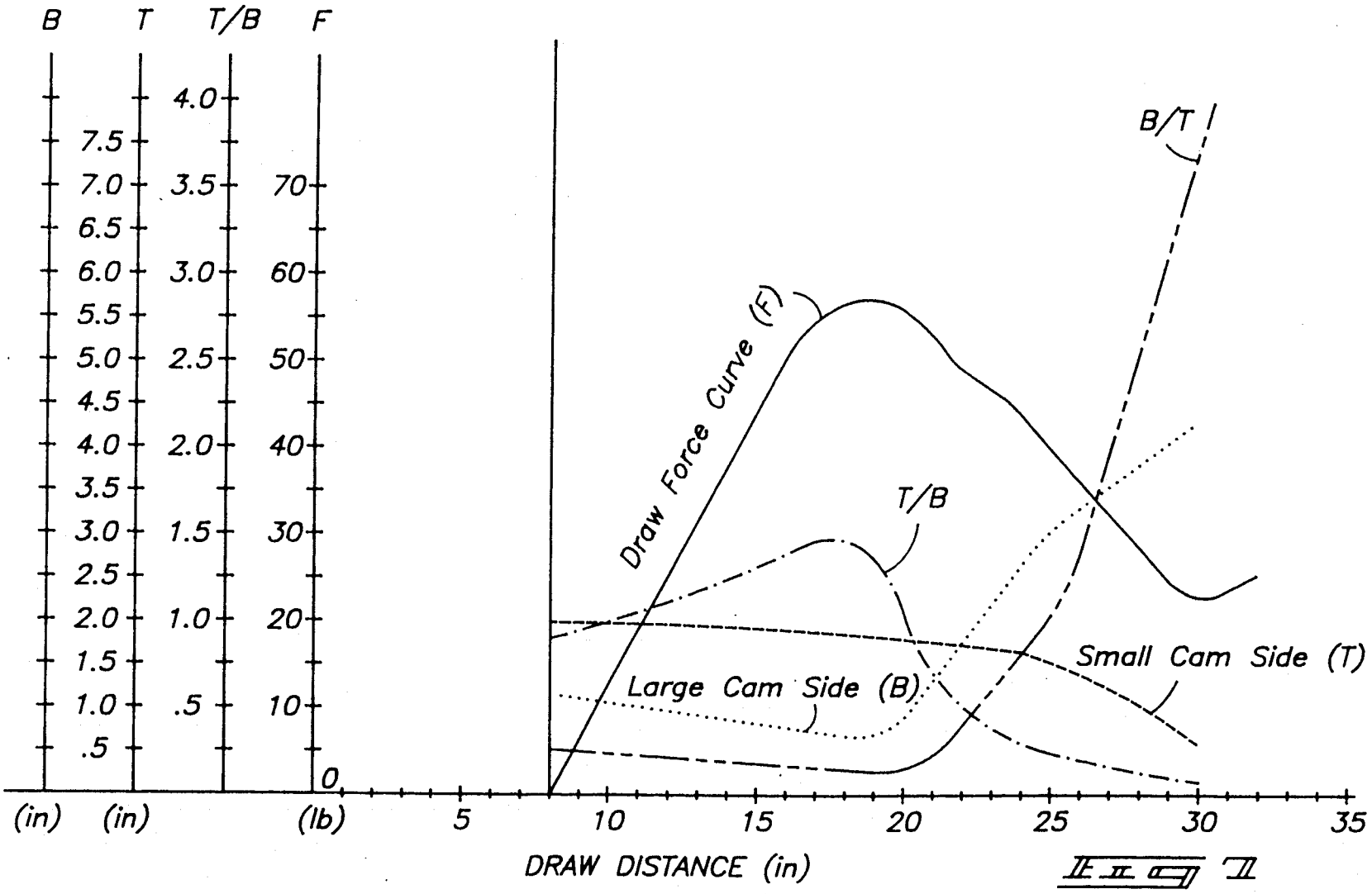
FIG. 11 is a set of superimposed graphs illustrating characteristics of the bow of FIGS. 8-10.

Characteristics of the FIGS. 8–10 bow are shown graphically in FIG. 11. Curve F is the force curve for the bow as a function of draw length and degree of rotation of wheel 17*c* and its opposing mirror image wheel. Curve B is a function of the moment arm of the large wheel 42*a* throughout draw. Curve T is a function of the moment arm of the small wheel 44*a* throughout draw. The respective ratios of T and B are illustrated by curves T/B and B/T.

In compliance with the statute, the invention has been described in language more or less specific as to structural and methodical features. It is to be understood, however, that the invention is not limited to the specific features shown and described, since the means and construction herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A compound archery bow comprising:

a central handle having opposing ends;

a pair of flexible power limbs extending outwardly from the handle opposing ends, each of the limbs having an inner end connected with the handle and an outer free end;

each of the outer free limb ends having a wheel receiving slot formed therein, the wheel receiving slot extending longitudinally from the outer free end toward the inner limb end to a slot root;

an eccentric wheel mounted in each wheel receiving slot for pivotal movement about an eccentric wheel pivot axis between a rest draw angular position and a full draw angular position, each wheel pivot axis extending transversely across a respective wheel receiving slot and being spaced an effective preset slot depth distance A from the respective slot root;

each of said eccentric wheels having a bowstring portion with a peripheral bowstring track formed therein for receiving a section of a bowstring, the peripheral bowstring track having a progressively increasing moment arm radius relative to the respective pivot axis from a rest draw segment to a full draw segment, the moment arm radius from the pivot axis to the full draw segment of the bowstring portion being greater than the effective slot depth distance A to extend the effective length of the respective flexible power limb at the full draw angular position by a distance greater than the slot depth; and each eccentric wheel having a power cable portion with a peripheral power cable track formed therein for receiving a section of a power cable.

2. The compound archery bow of claim 1 wherein the pivotal movement of the wheel between the rest angular position and the full draw angular position is less than 200 degrees.

3. The compound archery bow of claim 1 wherein the angular movement of the wheel between the rest angular position and the full draw angular position is less than 180 degrees.

4. The compound archery bow of claim 1 wherein the bowstring track is formed about an arc of varying radius.

5. The compound archery bow of claim 1 wherein the angular movement of the wheel between the rest angular position and the full draw angular position is less than or equal to 150 degrees.

6. The compound archery bow of claim 1 wherein the bowstring portion of the eccentric wheel includes an arched cantilever section that extends radially outward in an arch from the pivot axis to a tip defining the full draw segment.

7. The compound archery bow of claim 1 wherein, the full draw segment of the bowstring portion of the eccentric wheel has a moment arm radius N from the pivot axis;

the power cable portion of the eccentric wheel extends from a rest draw segment to a full draw segment and has a maximum moment arm radius P; and N is at least twice as great as P.

8. The compound archery bow of claim 1 wherein, the power cable portion of the eccentric wheel extends from a rest draw segment to a full draw segment and has a maximum moment arm radius P;

the bowstring track is semicircular having a constant radius R about a center point spaced from the eccentric pivot axis; and R is greater than P.

9. The compound archery bow of claim 1 wherein, the respective pivot axes are separated from one another by a distance C at the rest draw angular position; and the eccentric wheel full draw segments of the bowstring portions when in the rest draw angular position are positioned forwardly over the respective bow limbs and are separated from one another by a distance B, the distance B being less than the distance C thereby positioning the respective full draw segments in the rest draw angular position both forward over the bow limbs and in overcenter positions.

10. The compound archery bow of claim 9 wherein, the respective pivot axes are separated from one another by a distance C' at the full draw angular position; and the eccentric wheel full draw segments of the bowstring portions when in the full draw angular position are positioned rearwardly of the respective bow limbs and are separated from one another by a distance D, the distance D being greater than the distance C' thereby extending the effective lengths of the limbs at the full draw angular position and reducing bowstring pinch angle.

11. The compound archery bow of claim 1 wherein, the respective pivot axes are separated from one another by a distance C' at the full draw angular position; and the eccentric wheel full draw segments of the bowstring portions when in the full draw angular position are positioned rearwardly of the respective bow limbs and are separated from one another by a distance D, the distance D being greater than the distance C' thereby extending the effective lengths of the limbs at the full draw angular position and reducing bowstring pinch angle.

12. A compound archery bow comprising:

a central handle having opposing ends;

a pair of flexible power limbs extending outwardly from the handle opposing ends, each of the limbs having an inner end connected with the handle and an outer free end;

an eccentric wheel mounted at each outer free end for pivotal movement about a respective eccentric wheel pivot axis between a rest draw angular position and a full draw angular position, the respective pivot axes being separated from one another by a distance C at the rest draw angular position;

each of said eccentric wheels having a bowstring portion with a peripheral bowstring track formed therein for receiving a section of a bowstring, the peripheral bowstring track having a progressively increasing moment arm radius relative to the respective pivot axis from a rest draw segment to a full draw segment;

each eccentric wheel having a power cable portion with a peripheral power cable track formed therein for receiving a section of a power cable, the power cable portion extending from a rest draw segment to a full draw segment; and wherein the eccentric wheel full draw segments of the bowstring portions when in the rest draw angular position are positioned forwardly over the respective bow limbs and are separated from one another by a distance B, the distance B being less than the distance C thereby positioning the respective full draw segments in the rest draw angular position both forward over the bow limbs and in overcenter positions, the angular movement of the wheel between the rest angular position and the full draw angular position being less than or equal to 150 degrees.

13. A compound archery bow comprising:

a central handle having opposing ends;

a pair of flexible power limbs extending outwardly from the handle opposing ends, each of the limbs having an inner end connected with the handle and an outer free end;

an eccentric wheel mounted at each outer free end for pivotal movement about a respective eccentric wheel pivot axis between a rest draw angular position and a full draw angular position, the respective pivot axes being separated from one another by a distance C at the rest draw angular position;

each of said eccentric wheels having a bowstring portion with a peripheral bowstring track formed therein for receiving a section of a bowstring, the peripheral bowstring track having a progressively increasing moment arm radius relative to the respective pivot axis from a rest draw segment to a full draw segment;

each eccentric wheel having a power cable portion with a peripheral power cable track formed therein for receiving a section of a power cable, the power cable portion extending from a rest draw segment to a full draw segment; and wherein the eccentric wheel full draw segments of the bowstring portions when in the rest draw angular position are positioned forwardly over the respective bow limbs and are separated from one another by a distance B, the distance B being less than the distance C thereby positioning the respective full draw segments in the rest draw angular position both forward over the bow limbs and in overcenter positions;

the full draw segment of the bowstring portion of the eccentric wheel having a moment arm radius N from the pivot axis;

the power cable portion of the eccentric wheel extends from a rest draw segment to a full draw segment and has a maximum moment arm radius P; and N is at least twice as great as P.

14. A compound archery bow comprising:

a central handle having opposing ends;

a pair of flexible power limbs extending outwardly from the handle opposing ends, each of the limbs having an inner end connected with the handle and an outer free end;

an eccentric wheel mounted at each outer free end for pivotal movement about a respective eccentric wheel pivot axis between a rest draw angular position and a full draw angular position, the respective pivot axes being separated from one another by a distance C' at the full draw angular position;

each of said eccentric wheels having a bowstring portion with a peripheral bowstring track formed therein for receiving a section of a bowstring, the peripheral bowstring track having a progressively increasing moment arm radius relative to the respective pivot axis from a rest draw segment to a full draw segment;

each eccentric wheel having a power cable portion with a peripheral power cable track formed therein for receiving a section of a power cable, the power cable portion extending from a rest draw segment to a full draw segment; and wherein the eccentric wheel full draw segments of the bowstring portions when in the full draw angular position are positioned rearwardly of the respective bow limbs and are separated from one another by a distance D, the distance D being greater than the distance C' thereby extending the effective lengths of the limbs at the full draw angular position and reducing bowstring pinch angle, the angular movement of the wheel between the rest angular position and the full draw angular position being less than or equal to 150 degrees.

15. A compound archery bow comprising:

a central handle having opposing ends;

a pair of flexible power limbs extending outwardly from the handle opposing ends, each of the limbs having an inner end connected with the handle and an outer free end;

an eccentric wheel mounted at each outer free end for pivotal movement about a respective eccentric wheel pivot axis between a rest draw angular position and a full draw angular position, the respective pivot axes being separated from one another by a distance C' at the full draw angular position;

each of said eccentric wheels having a bowstring portion with a peripheral bowstring track formed therein for receiving a section of a bowstring, the peripheral bowstring track having a progressively increasing moment arm radius relative to the respective pivot axis from a rest draw segment to a full draw segment;

each eccentric wheel having a power cable portion with a peripheral power cable track formed therein for receiving a section of a power cable, the power cable portion extending from a rest draw segment to a full draw segment; and wherein the eccentric wheel full draw segments of the bowstring portions when in the full draw angular position are positioned rearwardly of the respective bow limbs and are separated from one another by a distance D, the distance D being greater than the distance C' thereby extending the effective lengths of the limbs at the full draw angular position and reducing bowstring pinch angle;

the full draw segment of the bowstring portion of the eccentric wheel having a moment arm radius N from the pivot axis;

the power cable portion of the eccentric wheel extends from a rest draw segment to a full draw segment and has a maximum moment arm radius P; and N is at least twice as great as P.

* * * * *